US010502038B2

(12) United States Patent
Zhang et al.

(10) Patent No.: US 10,502,038 B2
(45) Date of Patent: Dec. 10, 2019

(54) COMBINED OPERATION METHOD FOR WORK MODES OF WALKING BEAM PUMPING UNIT

(71) Applicant: HARBIN SURFICS ELECTRICAL TECHNOLOGY INC, Harbin (CN)

(72) Inventors: Min Zhang, Harbin (CN); Mingting Han, Harbin (CN); Jie Zhang, Harbin (CN); Wen Xing, Harbin (CN)

(73) Assignee: HARBIN SURFICS ELECTRICAL TECHNOLOGY INC, Harbin (CN)

( * ) Notice: Subject to any disclaimer, the term of this patent is extended or adjusted under 35 U.S.C. 154(b) by 0 days.

(21) Appl. No.: 16/301,739

(22) PCT Filed: May 10, 2017

(86) PCT No.: PCT/CN2017/083794
§ 371 (c)(1),
(2) Date: Nov. 15, 2018

(87) PCT Pub. No.: WO2017/198099
PCT Pub. Date: Nov. 23, 2017

(65) Prior Publication Data

US 2019/0120030 A1 Apr. 25, 2019

(30) Foreign Application Priority Data

May 17, 2016 (CN) ..... 2016 1 0326037

(51) Int. Cl.
*E21B 43/12* (2006.01)
*E21B 47/00* (2012.01)

(52) U.S. Cl.
CPC ..... *E21B 43/127* (2013.01); *E21B 47/0008* (2013.01); *E21B 2043/125* (2013.01)

(58) Field of Classification Search
CPC .... E21B 43/00; E21B 43/127; E21B 47/0008; E21B 2043/125; E21B 41/0092; F04B 47/022; F04B 47/028; F04B 49/00
See application file for complete search history.

(56) References Cited

U.S. PATENT DOCUMENTS

| | | | | |
|---|---|---|---|---|
| 9,033,676 B2 * | 5/2015 | Palka | ..... | E21B 43/127 417/44.1 |
| 2016/0265321 A1 * | 9/2016 | Elmer | ..... | E21B 47/0008 |

FOREIGN PATENT DOCUMENTS

| | | | |
|---|---|---|---|
| CN | 985421 | A1 | 12/1982 |
| CN | 1008422 | A1 | 3/1983 |
| CN | 1536197 | A | 10/2004 |
| CN | 101285463 | A | 10/2008 |
| CN | 102562000 | A | 7/2012 |
| CN | 104100241 | A | 10/2014 |
| CN | 106703758 | A | 5/2017 |

* cited by examiner

*Primary Examiner* — Michael R Wills, III
(74) *Attorney, Agent, or Firm* — Gokalp Bayramoglu

(57) ABSTRACT

The present invention discloses a combined operation method for work modes of a walking beam pumping unit, which relates to the field of oil production engineering. According to the number of the theoretical full-stroke pumping in a cycle, the number of the crank complete-cycle operation time, the times of respective complete-cycle operation, the number of the crank incomplete-cycle pumping operation times, travelling distances of the polished rod in respective incomplete-cycle pumping operation, the time of respective incomplete-cycle pumping operation, the number of the crank incomplete-cycle no-pumping operation times, the time of respective incomplete-cycle no-pumping operation, and the order of the crank complete-cycle operation, the crank incomplete-cycle pumping operation, and the crank incomplete-cycle no-pumping operation are arranged in the present invention.

7 Claims, No Drawings

COMBINED OPERATION METHOD FOR WORK MODES OF WALKING BEAM PUMPING UNIT

CROSS REFERENCE TO RELATED APPLICATIONS

This application is the national phase entry of International Application No. PCT/CN2017/083794, filed on May 10, 2017, which is based upon and claims priority to Chinese Patent Application No. 201610326037.2, filed on May 17, 2016, the entire contents of which are incorporated herein by reference.

TECHNICAL FIELD

The combined operation method for work modes of a walking beam pumping unit of the present invention pertains to the field of oil production engineering.

BACKGROUND

In the process of oil production, if the supply of fluid from the low-yield wells is insufficient, the theoretical displacement of a single-well needs to be reduced. Since the work mode of conventional operations of the walking beam pumping unit is limited to a continuous complete-cycle motion of the crank, the theoretical displacement of the single-well can only be reduced by the following technical means.

First, the means of reducing the working strokes in the whole process, which has the following problems. Due to the reduction of strokes in the complete cycle of the pumping unit, the problem that the leakage rate of the plunger pump gradually increases will be caused. Moreover, if the motor speed is reduced by the method of frequency conversion, the driving efficiency of the motor will gradually decrease as the motor speed decreases.

Second, the means of using the interval pumping work mode, namely, the work mode of alternately performing the mode of continuous complete-cycle motion of the crank and the mode of shutdown. This kind of work mode can solve the problems of high plunger leakage rate and low motor driving efficiency, but it will cause the following new problems. In one aspect, the transition from the shutdown state to the startup state requires a staff on duty. Because there are a large number of oil wells separated from each other by long distances, the operations of shutdown and startup are labor-intensive and waste many material resources. In another aspect, since the machine is started or shut down manually, it is difficult to start and shut down the machine for more than two times within 24 hours, and no pumping for a long time will cause large fluctuations on the dynamic fluid level and downhole flow pressure. As a result, the production capacity of a single well and the development of the pay zone will be adversely affected.

Patent application No. 201510783876.2, entitled "No-pumping Operation Method for Walking Beam Pumping Unit Based on Crank Incomplete-Cycle Motion", breaks through the technical bias that the walking beam pumping unit only has one operation mode, i.e., the crank continuous complete-cycle motion. With the incomplete-cycle swing motion of the crank, a no-pumping operation without the need of shutting down can be realized. If the traditional crank continuous complete-cycle motion is combined with the crank incomplete-cycle no-pumping motion proposed by the above patent, not only the strokes of a complete cycle are not required to be reduced, and the problems of large plunger leakage rate and low motor drive efficiency can be solved, but also manual startup and shut down operations are not required because the overground part of the pumping unit has never been shut down, thereby greatly reducing the consumption of manpower, material resources, and financial resources caused by manual startup and shut down operations on site.

However, in the practical production and operation, for the sake of safety warning, it is required to make the crank swing noticeably. While, the noticeable swings of the crank can cause the polished rod to move beyond the range of static deformation of the elasticity. As a result, it is hard to ensure the crank incomplete-cycle no-pumping motion, and the problem of theoretical displacement deviation will be caused. Meanwhile, if the area where the crank swings to a position close to a horizontal position, even a small angle rotation of the crank will also cause the polished rod to move beyond the range of the static deformation of elasticity. Accordingly, it is hard to ensure the crank incomplete-cycle no-pumping motion, and the problem of theoretical displacement deviation will be caused. In addition, when there is severe sand deposition in the oil well and the temperature is low (e.g. in the winter of Northern China), the time of the continuous no-pumping operation should not be too long, otherwise the problems of sand blocking, wax deposition, freezing blocking, and stratification are prone to occur. Based on these reasons, the crank incomplete-cycle pumping motion is essential in some special cases.

Patent application No. 201510838831.0, entitled "Dynamic Variable Stroke Operation Method for Walking Beam Pumping Unit Based on Crank Incomplete-cycle Motion", also breaks through the technical bias that the walking beam pumping unit only has one operation mode, i.e., the mode of crank continuous complete-cycle motion. The patent realizes a variable stroke pumping operation without shutting down based on the crank incomplete-cycle swing motion. If the traditional crank continuous complete-cycle motion is combined with the crank incomplete-cycle variable stroke pumping motion, or if the traditional crank continuous complete-cycle motion, the crank incomplete-cycle no-pumping motion, and the crank incomplete-cycle variable stroke pumping motion are combined, the following advantages can also be achieved. The problems of large plunger leakage rate and low motor drive efficiency can be solved while the strokes of the complete cycle need no reduction. Also, since the overground part of the pumping unit has never been shut down, manual startup operation is not required at all, thereby greatly reducing the consumption of manpower, material resources, and financial resources caused by manual startup operation on site. What's more, the use of the crank incomplete-cycle variable stroke pumping motion, not only can overcome the problem of the theoretical displacement deviation caused because it is hard to ensure the crank incomplete-cycle no-pumping motion, but also can meet the requirement of the reasonable distribution of flowing capacity through the crank incomplete-cycle pumping motion.

However, there is no relevant technical solution for how to implement the combination of the three work modes i.e. the crank complete-cycle operation, the crank incomplete-cycle pumping operation, and the crank incomplete-cycle no-pumping operation.

SUMMARY

In view of the above problems, the present invention discloses a combined operation method for work modes of a walking beam pumping unit, which combines a crank complete-cycle operation, a crank incomplete-cycle pumping operation, and a crank incomplete-cycle no-pumping operation, and provides the combination solution of the three work modes. Based on the combination solution provided by the present invention, there is no need to reduce the strokes of the whole cycle, so it is helpful in solving the problems of high plunger leakage rate and low motor driving efficiency. Moreover, since the startup operation is no longer required, the consumption of manpower, material resources, and financial resources caused by the manual startup operation on site can be saved. In addition, since the crank can swing noticeably, the safety warning demands can also be satisfied, and the requirements for the pumping motion regarding the problems of sand blocking, wax deposition, freezing blocking, and stratification are comprehensively considered.

The objective of the present invention is achieved as follows.

A combined operation method for work modes of a walking beam pumping unit, includes:

according to the number of theoretical full-stroke pumping N in a cycle T, and based on a case that the following conditions are satisfied:

$$T = \sum_{i=1}^{n1} t_i + \sum_{i=1}^{n2} t_j + \sum_{i=1}^{n3} t_k$$

$$N = n1 + \sum_{j=1}^{n2} \frac{(x_j - \text{static deformation length of elasticity})}{\text{travelling distance of polished rod in a complete cycle operation} - \text{static deformation length of elasticity}}$$

arranging the number of crank complete-cycle operation times $n_1$, times of respective complete-cycle operation $t_1$, $t_2, \ldots, t_{n1}$, the number of crank incomplete-cycle pumping operation times n2, travelling distances of a polished rod in respective incomplete-cycle pumping operation $x_1, x_2, \ldots, x_{n2}$, times of respective incomplete-cycle pumping operation $t_1, t_2, \ldots, t_{n2}$, the number of crank incomplete-cycle no-pumping operation times n3, times of respective incomplete-cycle no-pumping operation $t_1, t_2, \ldots, t_{n3}$, and an order of a crank complete-cycle operation, a crank incomplete-cycle pumping operation, and a crank incomplete-cycle no-pumping operation.

The above-mentioned combined operation method for work modes of the walking beam pumping unit, wherein a duration of the crank incomplete-cycle no-pumping operation is not greater than a minimum value of a sand deposition time threshold, a wax deposition time threshold, a freezing blocking time threshold, and a stratification time threshold.

The above-mentioned combined operation method for work modes of the walking beam pumping unit, wherein a duration of the crank incomplete-cycle no-pumping operation with a rotation angle less than 90 degrees is not greater than a lubrication time threshold for a gearbox of a speed reducer.

The above-mentioned combined operation method for work modes of the walking beam pumping unit, wherein a single cycle time of the crank complete-cycle operation is between two time thresholds of a motor drive efficiency range.

The above-mentioned combined operation method for work modes of the walking beam pumping unit, wherein a single cycle time of the crank complete-cycle operation is not lower than a pump efficiency affecting threshold.

The above-mentioned combined operation method for work modes of the walking beam pumping unit, wherein the number of crank continuous complete-cycle operation times is not lower than a continuous complete-cycle operation threshold.

The above-mentioned combined operation method for work modes of the walking beam pumping unit, wherein under an actual operation situation, actual travelling distances of the polished rod in respective incomplete-cycle pumping operation are $x_1', x_2', \ldots, x_{n2}'$, then an error value between the number of theoretical full-stroke pumping and the number of actual full-stroke pumping is calculated by the following formula:

$$N - n1 - \sum_{j=1}^{n2} \frac{x_j' - \text{static deformation length of elasticity}}{\text{travelling distance of polished rod in a complete cycle operation} - \text{static deformation length of elasticity}}$$

and the error value is recorded for correction in next cycle.

The present invention has the following advantages.

In the present invention, according to the number of the theoretical full-stroke pumping in a cycle, the number of the crank complete-cycle operation times, the times of respective complete-cycle operation, the number of the crank incomplete-cycle pumping operation times, travelling distances of the polished rod in respective incomplete-cycle pumping operation, the time of respective incomplete-cycle pumping operation, the number of the crank incomplete-cycle no-pumping operation times, the time of respective incomplete-cycle no-pumping operation, and the order of the crank complete-cycle operation, the crank incomplete-cycle pumping operation, and the crank incomplete-cycle no-pumping operation are arranged. By using this method, there is no need to reduce the strokes of the complete cycle, so it is helpful in solving the problems of high plunger leakage rate and low motor driving efficiency. Moreover, since the startup operation is no longer required, the consumptions of manpower, material resources, and financial resources caused by the manual startup operation on site can be saved. In addition, since the crank can swing noticeably, the safety warning demands can also be satisfied, and the requirements for the pumping motion regarding the problems of sand blocking, wax deposition, freezing blocking, and stratification are comprehensively considered.

DETAILED DESCRIPTION OF THE EMBODIMENTS

The specific embodiments of the present invention will be further described in detail hereinafter.

Embodiment 1

A combined operation method for work modes of a walking beam pumping unit according to this embodiment includes, according to the number of theoretical full-stroke pumping N in a cycle T, and based on a case that the following conditions are satisfied:

$$T = \sum_{i=1}^{n1} t_i + \sum_{i=1}^{n2} t_j + \sum_{i=1}^{n3} t_k$$

$$N = n1 + \sum_{j=1}^{n2} \frac{x_j - \text{static deformation length of elasticity}}{\text{travelling distance of polished rod in a complete cycle operation} - \text{static deformation length of elasticity}}$$

arranging the number of crank complete-cycle operation times n1, times of respective complete-cycle operation $t_1$, $t_2$, . . . , $t_{n1}$, the number of crank incomplete-cycle pumping operation times n2, travelling distances of a polished rod in respective incomplete-cycle pumping operation $x_1$, $x_2$, . . . , $x_{n2}$, times of respective incomplete-cycle pumping operation $t_1$, $t_2$, . . . , $t_{n2}$, the number of crank incomplete-cycle no-pumping operation times n3, times of respective incomplete-cycle no-pumping operation $t_1$, $t_2$, . . . , $t_{n3}$, and an order of a crank complete-cycle operation, a crank incomplete-cycle pumping operation, and a crank incomplete-cycle no-pumping operation.

The following three points of this embodiment should be noted.

First, the concept of the cycle of the present invention is a generalized concept, any time period can be regarded as a cycle.

Second, in the present invention, the static deformation length of the elasticity of the polished rod can be determined, and the travelling distances of the polished rod $x_1$, $x_2$, . . . , $x_{n2}$ also can be determined.

Third, the finally determined order of the crank complete-cycle operation, the crank incomplete-cycle pumping operation, and the crank incomplete-cycle no-pumping operation in the present invention is not a unique solution. Those skilled in the art can reasonably order the operations according to the method of this embodiment in combination of the practical production situations. Therefore, the specific data is not exemplified herein.

Embodiment 2

Based on the embodiment one, the combined operation method for work modes of the walking beam pumping unit of this embodiment further defines that a duration of the crank incomplete-cycle no-pumping operation is not greater than a minimum value of a sand deposition time threshold, a wax deposition time threshold, a freezing blocking time threshold, and a stratification time threshold.

If the pumping is not performed for a long time during the operation, problems such as sand deposition, wax deposition, freezing blocking, or stratification may occur. Accordingly, the limitations of this technical solution can effectively avoid the problems of sand deposition, wax deposition, freezing blocking, or stratification when there is no pumping operation for a long time.

Embodiment 3

Based on the embodiment one, the combined operation method for work modes of the walking beam pumping unit of this embodiment further defines that, a duration of the crank incomplete-cycle no-pumping operation with a rotation angle less than 90 degrees is not greater than a lubrication time threshold for a gearbox of a speed reducer.

Since the gears in the gearbox of the speed reducer of the walking beam pumping unit are arranged horizontally, if the crank swings at a rotation angle less than 90 degrees during operation, the problem that the contact surfaces of two gears cannot be lubricated by the lubricating oil will be caused. If the crank swings in such a manner for a long time, the service life of the gearbox of the speed reducer will be affected. However, the technical solution being limited in such a way enables the gears to be sufficiently lubricated and prolongs the service life of the gearbox of the speed reducer of the pumping unit.

Embodiment 4

Based on embodiment one, a combined operation method for work modes of the walking beam pumping unit of this embodiment further defines that, a single cycle time of the crank complete-cycle operation is between two time thresholds of a motor drive efficiency range.

The motion of the crank is driven by the rotation of the motor. When the speed of the motor is around a specific range of the rated speed, the efficiency is the highest, and the range is called high-efficiency-zone range. Since there is a clear conversion relationship between the rotation speed of the crank and the rotation speed of the motor under a determined transmission ratio, a range of the single cycle time of the crank complete-cycle operation can be derived according to the transmission ratio, so as to make sure that the motor rotation speed is within the high-efficiency-zone range. It is indicated that the technical solution being limited in such a way can ensure that the motor rotation speed is within the high-efficiency-zone range and saves energy.

Embodiment 5

Based on embodiment one, a combined operation method for work modes of the walking beam pumping unit of this embodiment further defines that, a single cycle time of the crank complete-cycle operation is not lower than a pump efficiency affecting threshold.

Since the withdrawal speed and the leakage rate of the plunger pump are inversely proportional, namely, the faster the speed, the lower the leakage rate of the plunger pump. Therefore, the technical solution being limited in such a way can make sure that the leakage rate of the plunger pump is in a low-level range, thereby improving pump efficiency.

Embodiment 6

Based on embodiment one, a combined operation method for word mode of the walking beam pumping unit of this embodiment further defines that, the number of crank continuous complete-cycle operation times is not lower than a continuous complete-cycle operation threshold.

Problems of electrical and mechanical shocks occurring during the start-up process of the crank complete-cycle operation, so the frequency of the start-up operation should be reduced as much as possible. In this embodiment, the technical solution is limited by the number of the crank continuous complete-cycle operation times, which can effectively avoid unnecessary start-up operations and play a role of device protection.

It should also be noted that the problems considered in the specific embodiments two to six are different problems. These problems can be considered comprehensively, namely, the technical solutions of the specific embodiments two to six can be performed in a combination of any two, any three, any four, or all the five embodiments, and the combined result is the intersection of the results of each technical solution.

Embodiment 7

According to the combined operation method for work modes of the walking beam pumping unit of this embodiment, in practical operations, the actual travelling distances of the polished rod in respective incomplete-cycle pumping operation are $x_1'$, $x_2'$, . . . , $x_{n2}'$, then an error value between the number of theoretical full-stroke pumping and the number of actual full-stroke pumping is calculated by the following formula:

$$N - n1 - \sum_{j=1}^{n2} \frac{x_j' - \text{static deformation length of elasticity}}{\text{travelling distance of polished rod in a complete cycle operation} - \text{static deformation length of elasticity}}$$

and the error value is recorded for correction in next cycle.

Here, an adjusting method is considered when there is a difference between the data of the actual operation result and the ideal data in the practical operations. Apparently, recording the error for the next cycle is only one of the technical means to adjust the error. Those skilled in the art are capable of coming up with the method of adjusting at any time during the operation of the current cycle, so this method is not illustrated in detail herein.

What is claimed is:

1. A combined operation method for work modes of a walking beam pumping unit, wherein according to the number of theoretical full-stroke pumping N in a cycle T, and based on a case that the following conditions are satisfied:

$$T = \sum_{i=1}^{n1} t_i + \sum_{i=1}^{n2} t_j + \sum_{i=1}^{n3} t_k$$

$$N = n1 + \sum_{j=1}^{n2} \frac{x_j - \text{static deformation length of elasticity}}{\text{travelling distance of polished rod in a complete cycle operation} - \text{static deformation length of elasticity}}$$

arranging the number of crank complete-cycle operation times n1, times of respective complete-cycle operation $t_1$, $t_2$, . . . , $t_{n1}$, the number of crank incomplete-cycle pumping operation times n2, travelling distances of a polished rod in respective incomplete-cycle pumping operation $x_1$, $x_2$, . . . , $x_{n2}$, times of respective incomplete-cycle pumping operation $t_1$, $t_2$, . . . $t_{n2}$, the number of crank incomplete-cycle no-pumping operation times n3, times of respective incomplete-cycle no-pumping operation $t_1$, $t_2$, . . . $t_{n3}$, and an order of a crank complete-cycle operation, a crank incomplete-cycle pumping operation, and a crank incomplete-cycle no-pumping operation.

2. The combined operation method for work modes of the walking beam pumping unit of claim 1, wherein a duration of the crank incomplete-cycle no-pumping operation is not greater than a minimum value of a sand deposition time threshold, a wax deposition time threshold, a freezing blocking time threshold, and a stratification time threshold.

3. The combined operation method for work modes of the walking beam pumping unit of claim 1, wherein a duration of the crank incomplete-cycle no-pumping operation with a rotation angle less than 90 degrees is not greater than a lubrication time threshold for a gearbox of a speed reducer.

4. The combined operation method for work modes of the walking beam pumping unit of claim 1, wherein a single cycle time of the crank complete-cycle operation is between two time thresholds of a motor drive efficiency range.

5. The combined operation method for work modes of the walking beam pumping unit of claim 1, wherein a single cycle time of the crank complete-cycle operation is not lower than a pump efficiency affecting threshold.

6. The combined operation method for work modes of the walking beam pumping unit of claim 1, wherein the number of crank continuous complete-cycle operation times is not lower than a continuous complete-cycle operation threshold.

7. The combined operation method far work modes of the walking beam pumping unit of claim 1, wherein under an actual operation situation, actual travelling distances of the polished rod in respective incomplete-cycle pumping operation are $x_{1'}$, $x_{2'}$, . . . , $x_{n2'}$, then an error value between the number of theoretical full-stroke pumping and the number of actual full-stroke pumping is calculated by the following formula:

$$N - n1 - \sum_{j=1}^{n2} \frac{x_j' - \text{static deformation length of elasticity}}{\text{travelling distance of polished rod in a complete cycle operation} - \text{static deformation length of elasticity}}$$

and the error value is recorded for correction in next cycle.

* * * * *